US009827539B2

(12) United States Patent
Ho et al.

(10) Patent No.: US 9,827,539 B2
(45) Date of Patent: Nov. 28, 2017

(54) DYNAMIC MIXER HEAD

(71) Applicant: Phillip Phung-I Ho, Santa Barbara, CA (US)

(72) Inventors: Phillip Phung-I Ho, Santa Barbara, CA (US); Chieh-Yu Cheng, New Taipei (TW); Chu-Chen Wang, New Taipei (TW); Chung-Chieh Lee, New Taipei (TW)

(73) Assignee: Phillip Phung-I Ho, Santa Barbara, CA (US)

( * ) Notice: Subject to any disclaimer, the term of this patent is extended or adjusted under 35 U.S.C. 154(b) by 188 days.

(21) Appl. No.: 14/814,768

(22) Filed: Jul. 31, 2015

(65) Prior Publication Data

US 2017/0028367 A1 Feb. 2, 2017

(51) Int. Cl.

*B01F 7/00* (2006.01)
*B05C 17/005* (2006.01)
*B01F 15/00* (2006.01)

(52) U.S. Cl.

CPC ..... *B01F 7/00141* (2013.01); *B01F 7/00216* (2013.01); *B01F 7/00258* (2013.01); *B01F 7/00275* (2013.01); *B01F 7/00633* (2013.01); *B01F 7/00641* (2013.01); *B01F 15/0087* (2013.01); *B05C 17/00566* (2013.01); *B01F 2215/0027* (2013.01); *B01F 2215/0039* (2013.01)

(58) Field of Classification Search

CPC ..... B01F 7/00291; B01F 7/00216; B01F 7/00766; B01F 13/002; B01F 7/00641; B01F 2215/0039; B01F 2215/0027; B01F 7/00275; B01F 7/0025–7/00333; B01F 7/00141; B01F 15/0087; B01F 7/00633; B01F 7/00258; A61C 9/0026; A61C 5/068; A61C 5/68; B05C 17/00566

USPC ..... 366/172.2, 176.1, 181.5, 325.1, 325.2, 366/326.1, 329.1, 329.2; 222/145.5, 222/145.6

See application file for complete search history.

(56) References Cited

U.S. PATENT DOCUMENTS 6,443,612 B1 9/2002 Keller
6,540,395 B2 4/2003 Muhlbauer et al.
6,932,243 B2 8/2005 Keller
(Continued)

FOREIGN PATENT DOCUMENTS

EP 2543430 A1 * 1/2013

*Primary Examiner* — Charles Cooley
(74) *Attorney, Agent, or Firm* — Lerner, David, Littenberg, Krumholz & Mentlik, LLP

(57) ABSTRACT

A dynamic mixer head has a connecting cover, a rotor and a housing. The connecting cover has a rotor opening. The rotor has a first rotor axle mounted in the rotor opening and a mixing rotor connected with the first rotor axle. The mixing rotor has multiple vaned inner rotors with quarter-circle shaped multiple vanes and a vaned front rotor opposite to a second rotor axle of the mixing rotor with multiple vanes complementary to the multiple vanes of the multiple vaned inner rotors. The housing mounted to the connecting cover has at least two grooves disposed on the circular partition. Each of the at least two grooves has a spacer along each of the at least two grooves. The dynamic mixer head can enhance the mixing effect of two different component substances during rotation.

16 Claims, 3 Drawing Sheets

(56) References Cited

U.S. PATENT DOCUMENTS

| | | | | |
|---|---|---|---|---|
| 7,287,898 | B2 * | 10/2007 | Pauser | B01F 15/0201 222/145.5 |
| 7,674,033 | B2 * | 3/2010 | Pauser | B01F 15/0201 222/145.5 |
| 7,731,413 | B2 * | 6/2010 | Busin | B01F 5/0619 222/145.6 |
| 8,313,232 | B2 * | 11/2012 | Keller | B01F 7/00125 366/162.3 |
| 8,365,958 | B2 * | 2/2013 | Ho | B01F 5/0615 |
| 8,651,731 | B2 * | 2/2014 | Wintergerste | B01F 7/00216 366/181.4 |
| 8,876,364 | B2 * | 11/2014 | Gartmann | B01F 7/00125 366/172.1 |
| 9,463,079 | B2 * | 10/2016 | Bublewitz | B01F 7/18 |
| 9,550,159 | B2 * | 1/2017 | Bublewitz | B05C 17/00513 |
| 9,656,224 | B2 * | 5/2017 | Linne | B01F 7/00233 |
| 2008/0264809 | A1 * | 10/2008 | Knispel | A61C 9/0026 206/219 |
| 2010/0102088 | A1 * | 4/2010 | Keller | B65D 81/325 222/137 |
| 2010/0208544 | A1 * | 8/2010 | Wintergerste | B01F 7/00216 366/134 |
| 2010/0256591 | A1 * | 10/2010 | Ho | A61C 5/64 |
| 2014/0198602 | A1 * | 7/2014 | Bublewitz | B01F 7/18 366/177.1 |
| 2015/0136806 | A1 * | 5/2015 | Jung | A61C 9/0026 222/145.5 |
| 2017/0028367 | A1 * | 2/2017 | Ho | B01F 7/00141 |
| 2017/0156820 | A1 * | 6/2017 | Hiemer | A61C 5/64 |

* cited by examiner

DYNAMIC MIXER HEAD

BACKGROUND OF THE INVENTION

1. Field of the Invention

The present invention relates to a dynamic mixer head, especially to a dynamic mixer head comprising a rotor with multiple vanes, and each of the multiple vanes are quarter-circle shaped, and the dynamic mixer head also especially relates to a dynamic mixer head comprising a housing with grooves comprising spacers.

2. Description of the Prior Art

A conventional dynamic mixer disclosed in U.S. Pat. No. 6,932,243 B2 is used to premix the components and comprises at least one rotor and at least two similarly configured inlets. The inlets are connected with respective outlets of the double cartridges or the dispensing appliance. The outlets have either equal diameters with the inlets, allowing the inlets to be inserted into the outlets, or different diameters, allowing one of the inlets to be fit over a smaller one of the outlets while another of the inlets fit into a larger one of the outlets.

A conventional dynamic mixer disclosed in U.S. Pat. No. 6,540,395 B2 is used to mix viscous compositions, in particular for components for dental impression compounds, and comprises a mixer tube, a rotor located in the latter, and an end wall with inlet opening through which the components to be mixed are passed into the mixer. Chambers are arranged on the rotor, and the compositions can flow out of the chamber through admission opens into the mixing channel and be stirred by mixer blades.

A conventional dynamic mixer disclosed in U.S. Pat. No. 8,651,731 B2 is used to mix viscous components, in particular for components for dental compositions, and comprises a rotor and a housing. The housing has a front inlet opening for the components and at least one outlet opening and the inner space of which includes a pre-chamber and a main chamber. The pre-chamber is opening into the main chamber in a distal, tapering transition section. The conical surface is disrupted by at least one channel as passage from the pre-chamber into the main chamber. The at least one channel comprises a surface opening on the conical surface, and the surface opening is extended between a closed end and an open end which is opening into the main chamber with the width of the at least one channel extending over a part of the periphery of the transition section.

However, in order to enhance the mixing effect, none of the dynamic mixers disclosed in the above disclosures can help the different components neither to be split into smaller streams nor to be deflected back into the mixing chambers of the rotor.

To overcome the shortcomings, the present invention provides a dynamic mixer head to mitigate or obviate the aforementioned problems.

SUMMARY OF THE INVENTION

The main objective of the invention is to provide a dynamic mixer head.

The dynamic mixer head in accordance with the present invention has a connecting cover, a rotor and a housing. The connecting cover comprises a circular surface, a periphery connecting with and surrounding the circular surface, at least two outlet openings disposed on the circular surface, and a rotor opening disposed on the circular surface and next to the at least two outlet openings.

The rotor has a rotor axle, a mixing portion and a mixing rotor. The rotor axle is detachably mounted in the rotor opening of the cylindrical inner portion. The mixing portion is connected to the rotor axle. The mixing rotor comprises a rotor axle, multiple vaned inner rotors and a vaned front rotor. The rotor axle is connected with the mixing portion. The multiple vaned inner rotors comprise multiple vanes and the multiple vaned inner rotors are arranged at intervals along the rotor axle of the mixing rotor. Each of the multiple vanes is shaped like a quarter-circle in an axial view and arranged at intervals surrounding the rotor axle of the mixing rotor, allowing to form a channel extending between the vaned inner rotors to the vaned inner rotors and parallel to an axis of the rotor axle of the mixing rotor.

The vaned front rotor is composed of multiple vanes and the vaned front rotor is mounted on the rotor axle of the mixing rotor opposite to the mixing portion and adjacent to one of the multiple vaned inner rotors. Each of the multiple vanes of the vaned front rotor is shaped like a quarter-circle complementary to the multiple vanes of the vaned inner rotors in an axial view and arranged at intervals surrounding the rotor axle of the mixing rotor and each of the multiple vanes of the vaned front rotor is positioned corresponding to the channel of the multiple vaned inner rotors.

The housing comprises a circular partition, at least two grooves, a shorter cylinder section, a longer cylinder section, and an outlet. The at least two grooves are disposed on the partition, and one end of each of the at least two grooves is respectively corresponding to one of each of the at least two outlet openings. Each of the at least two grooves comprises a spacer along each of the at least two grooves.

The shorter cylinder section preferably accommodates the mixing rotor and connects and communicates with one end of each of the at least two grooves opposite to the other end of each of the at least two grooves corresponding to one of the at least two outlet openings. The longer cylinder section is connected with the shorter cylinder section.

Preferably, the amount of the at least two outlet openings is two.

Preferably, the amount of the at least two grooves is two.

Preferably, the amount of the multiple vaned inner rotors is five.

Preferably, the amount of the multiple vanes of the vaned front rotor is four.

Preferably, the diameter of the longer cylinder section is smaller than the diameter of the shorter cylinder section.

Preferably, the connecting cover further comprises a cylindrical outer rim. The cylindrical outer rim comprises a cylindrical inner wall with an inner thread.

Preferably, the housing further comprises a periphery and a space. The periphery of the housing is connected to the partition and comprises an inner peripheral wall and an outer peripheral wall with an outer thread which is complementary to the inner thread of the connecting cover. The space is surrounded by the partition and the inner peripheral wall, and the space accommodates the cylindrical inner portion.

Preferably, the amount of the at least two outlet openings of the connecting cover is two and the two outlet openings include a first outlet opening and a second outlet opening. The first outlet opening and the second outlet opening are respectively disposed on the circular surface of the connecting cover and are respectively disposed close to the periphery of the cylindrical inner portion.

Preferably, the amount of the at least two grooves of the housing is two and the two grooves include a first groove and a second groove. The first groove and the second groove of the housing are disposed on the partition and are adjacent to the inner peripheral wall. One end of the first groove of the housing is corresponding to the first outlet opening of the connecting cover, and one end of the second groove of the housing is corresponding to the second outlet opening of the connecting cover.

Preferably, the first groove of the housing further comprises a first spacer and the second groove of the housing further comprises a second spacer.

Preferably, the connecting cover further comprises at least two grooves disposed on the circular surface of the connecting cover. More preferably, the amount of the at least two grooves of the connecting cover is two and the two grooves include a first groove and a second groove.

Preferably, the housing further comprises at least two protrusions mounted on the circular partition of the housing. More preferably, the amount of the at least two protrusions is two and the two protrusions include a first protrusion mounted on the first groove of the connecting cover and a second protrusion mounted on the second groove of the connecting cover.

Preferably, the cylindrical inner portion of the connecting cover further comprises a linear groove disposed between the rotor opening, the first outlet opening and the second outlet opening.

Preferably, the housing further comprises a projection between the first groove and the second groove of the housing, and the projection is mounted on the linear groove of the connecting cover.

The multiple vanes of the vaned front rotor allow the two component substances to be deflected back into the mixing chambers of the rotor. Besides, the first spacer of the first groove and the second spacer of the second groove of the housing allow two different component substances to be split and deflected respectively into the first groove and the second groove for enhancing the mixing effect. Therefore, the dynamic mixer head of the present invention can enhance the mixing effect of two different component substances during rotation.

DETAILED DESCRIPTION OF THE PREFERRED EMBODIMENTS

Figure 1:
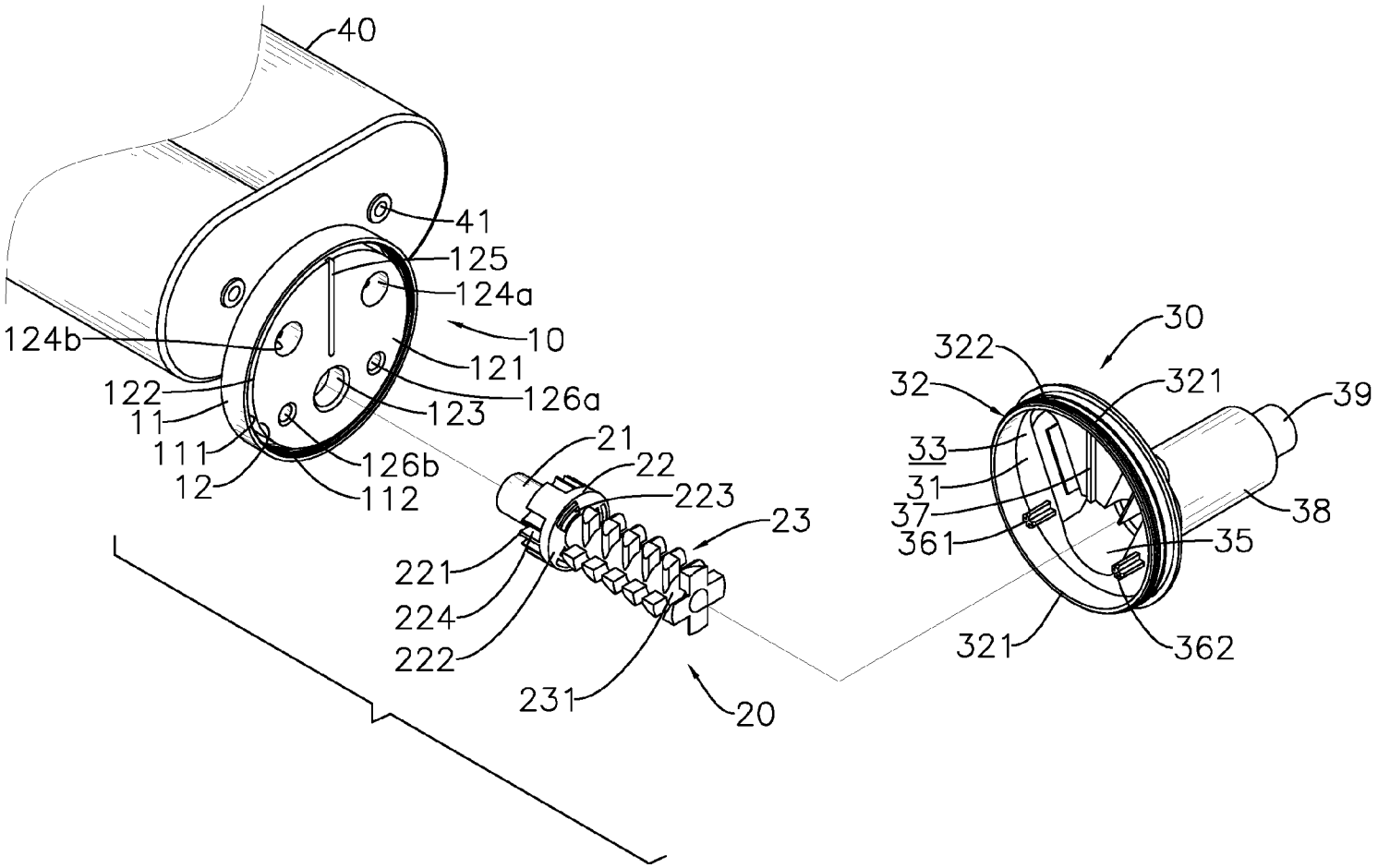
FIG. 1 is an exploded perspective view of a dynamic mixer head in accordance with the present invention.

With reference to FIG. 1, a dynamic mixer head in accordance with the present invention comprises a connecting cover 10, a rotor 20 and a housing 30.

The connecting cover 10 is cylindrical and comprises a cylindrical outer rim 11 and a cylindrical inner portion 12 positioned inside the cylindrical outer rim 11. The cylindrical outer rim 11 comprises a cylindrical inner wall 111 with an inner thread 112.

The cylindrical inner portion 12 comprises a circular surface 121, a periphery 122, a rotor opening 123, at least two outlet openings, a linear groove 125, and at least two grooves. The periphery 122 of the cylindrical inner portion 12 is connected with and surrounds the circular surface 121. The amount of the at least two outlet openings of the embodiment is two and the at least two outlet openings include a first outlet opening 124*a* and a second outlet opening 124*b*. The diameters of the first outlet opening 124*a* and the second outlet opening 124*b* are equal, and the first outlet opening 124*a* and the second outlet opening 124*b* are respectively disposed on the circular surface 121 and are respectively disposed close to the periphery 122 of the cylindrical inner portion 12. The rotor opening 123 has a diameter larger than diameters of the first outlet opening 124*a* and the second outlet opening 124*b*. The rotor opening 123 is disposed on the circular surface 121 and is disposed close to the periphery 122 of the cylindrical inner portion 12. The rotor opening 123, the first outlet opening 124*a* and the second outlet opening 124*b* form a triangle on the circular surface 121. The linear groove 125 is disposed on the circular surface 121 and between the rotor opening 123, the first outlet opening 124*a* and the second outlet opening 124*b*. One end of the linear groove 125 is connected to the periphery 122 of the cylindrical inner portion 12, and the other end of the linear groove 125 is close to the rotor opening 123 of the cylindrical inner portion 12. The amount of the at least two grooves of the present embodiment is two and the at least two grooves include a first groove 126*a* and a second groove 126*b*. The first groove 126*a* and the second groove 126*b* are disposed on the circular surface 121 of the cylindrical inner portion 12, and the first groove 126*a* and the second groove 126*b* are respectively disposed adjacent to the rotor opening 123.

Figure 2:
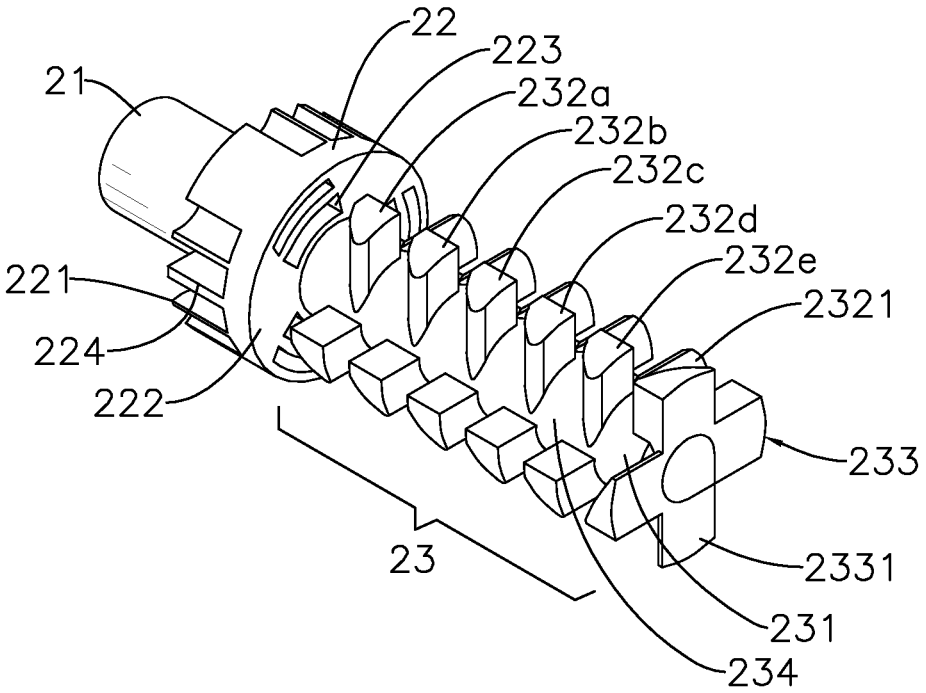
FIG. 2 is a perspective view of a rotor of the dynamic mixer head in FIG. 1.

With references to FIGS. 1 and 2, the rotor 20 comprises a rotor axle 21, a mixing portion 22, and a mixing rotor 23. The rotor axle 21 is detachably mounted in the rotor opening 123 of the cylindrical inner portion 12. The mixing portion 22 is cylindrical with multiple partitions 221 and connects with the rotor axle 21. The mixing portion 22 comprises a surface 222 and multiple holes 223. The surface 222 is positioned opposite to the multiple partitions 221, and the multiple partitions 221 are radially arranged at intervals on the mixing portion 22, allowing multiple mixing spaces 224 to be formed between two of the multiple partitions 221 adjacent to each other. The multiple holes 223 are disposed on the surface 222 of the mixing portion 22.

The mixing rotor 23 is elongated rod-shaped and comprises a rotor axle 231, multiple vaned inner rotors 232*a-e* and a vaned front rotor 233. The rotor axle 231 is connected with the surface 222 of the mixing portion 22. Each of the multiple vaned inner rotors 232*a-e* is composed of multiple vanes 2321, and each of the multiple vanes 2321 of the multiple vaned inner rotors 232*a-e* is shaped like a quarter-circle in an axial view of the mixing rotor 23. In the present embodiment, the multiple vaned inner rotors 232*a-e* are arranged at intervals along the rotor axle 231. In the present embodiment, the amount of the multiple vanes 2321 of each of the multiple vaned inner rotors 232*a-e* is four, and the four vanes 2321 of each of the multiple vaned inner rotors 232*a-e* are arranged at intervals surrounding the rotor axle 231, allowing four channels 234 to be extended from the vaned inner rotor 232*a* to the vaned inner rotor 232*e* and parallel to an axis of the rotor axle 231 of the mixing rotor 23.

The vaned front rotor 233 is mounted on the rotor axle 231 of the mixing rotor 23 opposite to the surface 222 of the mixing portion 22 and adjacent to the vaned inner rotor 232*e*. The vaned front rotor 233 is composed of multiple vanes 2331, and each of the multiple vanes 2331 of the vaned front rotor 233 is shaped like a quarter-circle complementary to the vanes 2321 of the four vaned inner rotors 232 *a-e* in an axial view and the multiple vanes 2331 are arranged at intervals surrounding the rotor axle 231. In the present embodiment, the amount of the multiple vanes 2331 of the vaned front rotor 233 is four. The four vanes 2331 are arranged at intervals surrounding the rotor axle 231, and each of the vanes 2331 of the vaned front rotor 233 is respectively positioned corresponding to each of the four channels 234.

Figure 3:
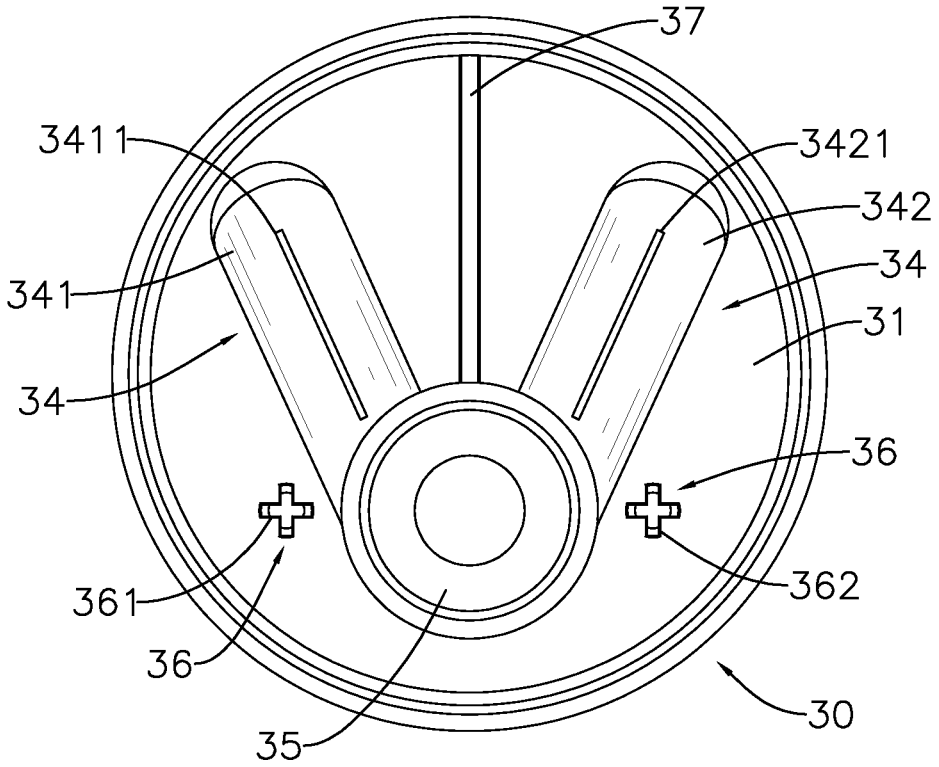
FIG. 3 is a plane view of a housing of the dynamic mixer head in FIG. 1.

With references to FIGS. 1 and 3, the housing 30 comprises a circular partition 31, a periphery 32, a space 33, at least two grooves 34, a shorter cylinder section 35, at least two protrusions 36, a projection 37, a longer cylinder section 38 and an outlet 39. The periphery 32 of the housing 30 comprises an inner peripheral wall 321 and an outer peripheral wall 322 with an outer thread.

The partition 31 is connected to the periphery 32 of the housing 30, and the outer thread of the outer peripheral wall 322 is complementary to the inner thread 112 of the cylindrical outer rim 11. The space 33 is surrounded by the partition 31 and the inner peripheral wall 321, and the space 33 accommodates the cylindrical inner portion 12.

In the present embodiment, the amount of the at least two grooves 34 is two and the at least two grooves 34 include a first groove 341 and a second groove 342. The first groove 341 and the second groove 342 are disposed on the partition 31. One end of the first groove 341 and one end of the second groove 342 are adjacent to the inner peripheral wall 321 and the first groove 341 and the second groove 342 are respectively corresponding to the first outlet opening 124*a* and the second outlet opening 124*b* of the cylindrical inner portion 12. The first groove 341 and the second groove 342 respectively form a first spacer 3411 parallel to the first groove 341 and a second spacer 3421 parallel to the second groove 342.

The shorter cylinder section 35 is mounted on the partition 31 and adjacent to the inner peripheral wall 321 of the housing 30. The shorter cylinder section 35 is connected to and communicates with one end of the first groove 341 and one end of the second groove 342 opposite to the inner peripheral wall 321 of the housing 30. The shorter cylinder section 35 preferably accommodates the mixing portion 22 and part of the mixing rotor 23 of the rotor 20.

The at least two protrusions 36 include a first protrusion 361 and a second protrusion 362 respectively mounted on the partition 31 oppositely beside the shorter cylinder section 35. The first protrusion 361 is detachably mounted in the first groove 126*a* of the cylindrical inner portion 12. The second protrusion 362 is detachably mounted in the second groove 126*b* of the cylindrical inner portion 12.

The projection 37 is elongated and is mounted on the partition 31 between the first groove 341 and the second groove 342. One end of the projection 37 is connected to the inner peripheral wall 321 of the housing 30; the other end of the projection 37 is connected to and communicates with the shorter cylinder section 35. The projection 37 is detachably mounted in the linear groove 125 of the cylindrical inner portion 12.

The longer cylinder section 38 is connected with the shorter cylinder section 35, and the diameter of the longer cylinder section 38 is smaller than the diameter of the shorter cylinder section 35. The longer cylinder section 38 preferably accommodates the mixing rotor 23 excluding from part of the mixing rotor 23 positioned in the shorter cylinder section 35.

The outlet 39 is connected to and communicates with the longer cylinder section 38 opposite to the shorter cylinder section 35 of the housing 30, and the diameter of the outlet 39 is smaller than the diameter of the longer cylinder section 38.

With reference to FIGS. 1 to 3, as the present invention is used to mix two different component substances contained in each of the cartridges 40. The rotor axle 21 of the rotor 20 is mounted in and through the rotor opening 123 of the connecting cover 10, allowing the rotor axle 21 to be connected with a rotor motor for driving. Two outlets 41 of the cartridges 40 are respectively connected with the two inlets respectively opposite to the first outlet opening 124*a* and the second outlet opening 124*b* of the connecting cover 10, allowing the two different component substances respectively to be passed through the first outlet opening 124*a* to the first groove 341; and passed through the second outlet opening 124*b* to the second groove 342. The two different component substances are then mixed in the mixing portion 22 in the housing 30. The first spacer 3411 of the first groove 341 and the second spacer 3421 of the second groove 342 allow the two different component substances to be split and deflected into the first groove 341 and the second groove 342 for enhancing the mixing effect. Then, the two different component substances are mixed in the channels 234 and passed through the multiple holes 223 of the mixing portion 22 followed by mixing between the vanes 2321 of the five multiple vaned inner rotors 232*a-e* by rotation. Besides, owing to that the direction of each of the multiple vanes 2331 of the vaned front rotor 233 is opposite to the direction of the vanes 2321 of the vaned inner rotors 232 *a-e*, each of the multiple vanes 2331 of the vaned front rotor 233 allows the mixer of the two different component substances to be deflected back to the longer cylinder section 38 away from the outlet 39 of the housing 30. Therefore, the dynamic mixer head of the present invention can enhance the mixing effect of two different component substances during rotation.

The invention claimed is:

1. A dynamic mixer head comprising:

a connecting cover being cylindrical and comprising a cylindrical inner portion comprising a circular surface;

a periphery connecting with and surrounding the circular surface;

at least two outlet openings disposed on the circular surface; and a rotor opening disposed on the circular surface and next to the at least two outlet openings;

a rotor having a first rotor axle detachably mounted in the rotor opening of the cylindrical inner portion;

a mixing portion being cylindrical and connecting with the first rotor axle of the rotor; and a mixing rotor being elongated rod-shaped and comprising a second rotor axle connected with the mixing portion;

multiple vaned inner rotors, wherein the multiple vaned inner rotors are arranged at intervals along the second rotor axle of the mixing rotor and each of the multiple vaned inner rotors is composed of multiple vanes, wherein each of the multiple vanes is shaped like a quarter-circle in an axial view and arranged at intervals surrounding the second rotor axle of the mixing rotor, allowing to form a channel extending between the vaned inner rotors and parallel to an axis of the second rotor axle of the mixing rotor; and a vaned front rotor mounted on the second rotor axle of the mixing rotor opposite to the mixing portion and adjacent to one of the multiple vaned inner rotors; the vaned front rotor being composed of multiple vanes, wherein each of the multiple vanes of the vaned front rotor is shaped like a quarter-circle complementary to the vanes of the vaned inner rotors in an axial view and arranged at intervals surrounding the second rotor axle of the mixing rotor and each of the multiple vanes of the vaned front rotor is positioned corresponding to the channel of the multiple vaned inner rotors; and a housing comprising a circular partition;

at least two grooves disposed on the partition, wherein one end of each of the at least two grooves is respectively corresponding to one of each of the at least two outlet openings; each of the at least two grooves respectively comprising a spacer along each of the at least two grooves;

a shorter cylinder section accommodating the mixing rotor and connecting with one end of each of the at least two grooves opposite to the other end of each of the at least two grooves corresponding to one of the at least two outlet openings;

a longer cylinder section connected to and communicating with the shorter cylinder section; and an outlet connected to and communicating with the longer cylinder section opposite to the shorter cylinder section of the housing.

2. The dynamic mixer head as claimed in claim 1, wherein the amount of the at least two outlet openings is two.

3. The dynamic mixer head as claimed in claim 1, wherein the amount of the at least two grooves is two.

4. The dynamic mixer head as claimed in claim 1, wherein the amount of the multiple vaned inner rotors is five.

5. The dynamic mixer head as claimed in claim 1, wherein the amount of the multiple vanes of each of the multiple vaned inner rotors is four.

6. The dynamic mixer head as claimed in claim 1, wherein the amount of the multiple vanes of the vaned front rotor is four.

7. The dynamic mixer head as claimed in claim 1, wherein the diameter of the longer cylinder section is smaller than the diameter of the shorter cylinder section.

8. The dynamic mixer head as claimed in claim 1, wherein the connecting cover further comprises a cylindrical outer rim; wherein the cylindrical outer rim comprises a cylindrical inner wall with an inner thread.

9. The dynamic mixer head as claimed in claim 8, wherein the housing further comprises a periphery and a space, wherein the periphery of the housing is connected to the partition, and the periphery of the housing comprises an inner peripheral wall and an outer peripheral wall with an outer thread which is corresponding to the inner thread of the connecting cover; wherein the space is surrounded by the partition and the inner peripheral wall, and the space accommodates the cylindrical inner portion.

10. The dynamic mixer head as claimed in claim 9, wherein the amount of the at least two outlet openings of the connecting cover is two and the two outlet openings include a first outlet opening and a second outlet opening; wherein the first outlet opening and the second outlet opening are respectively disposed on the circular surface of the connecting cover and are respectively positioned close to the periphery of the cylindrical inner portion.

11. The dynamic mixer head as claimed in claim 10, wherein the amount of the at least two grooves of the housing is two and the two grooves include a first groove and a second groove, wherein the first groove and the second groove of the housing are disposed on the partition and are adjacent to the inner peripheral wall; wherein one end of the first groove of the housing is corresponding to the first outlet opening, and one end of the second groove of the housing is corresponding to the second outlet opening of the connecting cover.

12. The dynamic mixer head as claimed in claim 11, wherein the first groove of the housing further comprises a first spacer and the second groove of the housing comprises a second spacer.

13. The dynamic mixer head as claimed in claim 10, wherein the cylindrical inner portion of the connecting cover further comprises a linear groove disposed between the rotor opening, the first outlet opening and the second outlet opening.

14. The dynamic mixer head as claimed in claim 11, wherein the housing further comprises a projection between the first groove and the second groove of the housing; wherein the projection is corresponding to the linear groove of the connecting cover.

15. The dynamic mixer head as claimed in claim 1, wherein the connecting cover further comprises at least two grooves disposed on the circular surface of the connecting cover; wherein the amount of the at least two grooves is two and the two grooves include a first groove and a second groove.

16. The dynamic mixer head as claimed in claim 15, wherein the housing further comprises at least two protrusions mounted on the circular partition of the housing; wherein the amount of the at least two protrusions is two and the two protrusions include a first protrusion corresponding to the first groove of the connecting cover and a second protrusion corresponding to the second groove of the connecting cover.

* * * * *